United States Patent [19]

Nelson

[11] 3,990,743

[45] Nov. 9, 1976

[54] BACK SUPPORT ASSEMBLY FOR BOAT SEATS

[76] Inventor: Holace W. Nelson, 2036 Hawthorne Ave., St. Paul, Minn. 55119

[22] Filed: May 23, 1975

[21] Appl. No.: 580,216

[52] U.S. Cl. ..... 297/352; 9/7; 297/452

[51] Int. Cl.[2] ..... A47C 15/00; B63B 29/00

[58] Field of Search ..... 297/352, 353, 440, 452; 9/7

[56] References Cited

UNITED STATES PATENTS

| | | | |
|---|---|---|---|
| 430,218 | 7/1890 | O'Leary | 9/7 |
| 679,058 | 7/1901 | Mellen | 248/188.91 |
| 849,604 | 4/1907 | Fortiner | 297/452 X |
| 1,026,898 | 5/1912 | Benson | 9/7 |
| 1,592,881 | 1/1926 | Albert et al. | 297/352 |
| 1,934,307 | 11/1933 | Hardester | 297/252 |
| 2,472,185 | 6/1949 | Apel | 9/7 |
| 2,572,623 | 10/1951 | Hoppenstand | 9/7 UX |
| 3,266,843 | 8/1966 | Feder | 297/440 |
| 3,795,927 | 3/1974 | Darwin et al. | 9/7 |
| 3,853,351 | 12/1974 | Lassiter | 297/452 |

*Primary Examiner*—James T. McCall
*Attorney, Agent, or Firm*—Dean P. Edmundson

[57] ABSTRACT

A back support assembly is provided which is adapted for use in a conventional boat (e.g., canoe) of the type having rigidly disposed seats. The back support assembly can be easily and quickly associated with the conventional seat and is also light-weight and inexpensive. The back support relieves strain on the back of the occupant of the seat and can be easily changed from one side of the seat to the other side, depending upon which direction the occupant desires to face. For portaging the back support is quickly disassembled and carried within the boat.

12 Claims, 5 Drawing Figures

BACK SUPPORT ASSEMBLY FOR BOAT SEATS

BACKGROUND OF THE INVENTION

Recreational boating in various types of boats or vessels has always been popular, and activities such as canoe voyaging have become increasingly more widespread over the past few years. While such boating activities are quite popular and are engaged in by a variety of enthusiasts there has always been one serious disadvantage associated therewith. This disadvantage relates to the fact that conventional small boat seats do not have a back support. Consequently, boat occupants are forced to assume postures that often result in aching or tired backs, particularly in prolonged use commonly associated with fishing or recreational canoeing. Although others have previously proposed certain types of boat seats or attachments for boat seats to make the occupant more comfortable in small boats, these proposed seats and attachments have not been totally satisfactory for a number of reasons and have not been practical or safe for use in a canoe. For example, some have proposed back supports which were designed to rest upon and be attached to the canoe's rigidly disposed seat by means of hooks, spring clips or clamps. This has, however, proven unsatisfactory because such attachment means lacks rigidity and accordingly does not maintain the back support steady. Furthermore, the force applied against the back support by an occupant of the seat creates a large torque or twisting of the seat against its anchorings.

Others have proposed cushioned or molded seats with integrally attached back supports designed to rest upon and be attached to the seat. These have also been unsatisfactory for the foregoing reasons and, in addition, are too heavy and clumsy for portaging. Furthermore, such seats are somewhat unsafe for use in canoes since they raise the center of gravity of the canoe load by raising the sitting position of the occupant. This tends to make the canoe more unstable in the water and increases the danger of tipping.

Still others have proposed the use of cushioned swivel seats having integrally attached back supports. These seats have been unsatisfactory for the reasons discussed above, and they also create the added peril of upsetting the canoe by unintentional swivelling.

In spite of the widespread enthusiasm and activity in canoeing there has not heretofore been provided a means for effectively, efficiently, and safely alleviating the concomittant strain on the canoeist's back. The present invention provides a back support which overcomes these problems.

SUMMARY OF THE INVENTION

In accordance with the invention there is provided an inexpensive back support assembly which is adapted for use in any conventional boat (e.g., canoe) having a rigidly disposed seat. The back support assembly, in one embodiment, comprises:

a. an elongated back rest member disposed in an upright manner with respect to the boat seat, the lower end of the back rest member being below the seat and the upper end being above the seat;

b. a strut member having a first end and a second end, the first end adapted to be coupled (preferably in a detachable manner) to the lower end of the back rest member and being supported by the floor of the boat, and the second end being supported against the front portion of the seat;

c. brace means cooperating with the back rest member to transmit rearward force applied to the back rest member to the strut member and the front portion of the seat.

Because the brace means and strut member absorb and distribute the rearward force against the back rest member, the force is not concentrated on any one portion of the seat or boat. Consequently, there is no unsafe stress on any part of the seat or the boat. The back support assembly is light-weight and is easily and quickly assembled and disassembled. Consequently, the assembly does not interfere with portaging. Furthermore, the assembly does not change the sitting height of the occupant of the seat. Consequently, the center of gravity of the loaded boat is not raised.

The invention, is another embodiment, comprises a back support adapted to be removably attached to rigidly disposed cross members, or to a rigid upright surface, in a boat carrying at least two loop shaped retaining means vertically separated from each other. The back support comprises an elongated bar having an upper back rest portion and a lower portion, the lower portion having first and second attachment means vertically separated from each other on the bar. The first attachment means comprises an upwardly projecting finger adapted to be received by one of the loop shaped retaining means, and the second attachment means comprises a downwardly projecting finger adapted to be received by the other of said loop shaped retaining means. The back support is light-weight, easy to connect, and provides a steady support for an occupant of the seat.

DETAILED DESCRIPTION OF THE INVENTION

The invention is described in more detail hereinafter with reference to the accompanying drawings wherein like reference characters refer to the same parts throughout the several views and in which.

Figure 1:
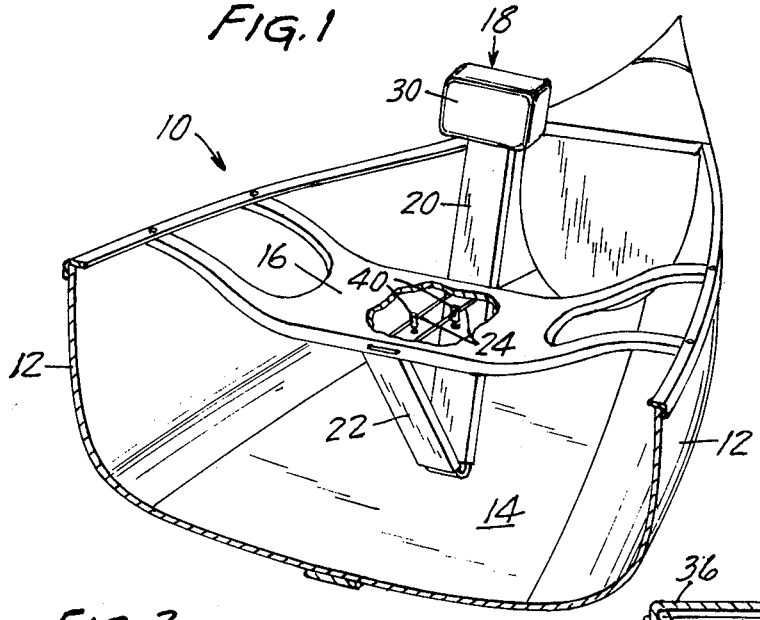
FIG. 1 is a perspective view of one embodiment of the back support assembly associated with a rigidly disposed seat in a conventional boat.

Thus, in FIG. 1 there is shown a perspective view of a portion of a conventional boat 10 (for example, a canoe) having sides 12, a floor 14 and a rigidly disposed seat 16 connected at each end to sides 12. Back support assembly 18 ia associated with the seat and it comprises elongated back rest member 20, strut member 22, and brace means 24. The back support assembly is shown in cross-section in FIG. 2.

Back rest member 20 is disposed in a generally upright manner with respect to seat 16, the lower end 26 of back rest member 20 being below seat 16 and the upper end 28 being above seat 16. Resilient pad means 30 is preferably detachably mounted to the upper end of the back rest member so as to make it a more comfortable support for an occupant of the seat. The position of pad means 30 on back rest member 20 may be adjusted up or down to accommodate the desires of the occupant of the seat. Pad means 30 may also be detached from the back rest member and fastened to one of the thwarts of the boat to serve as shoulder pads for easy and comfortable portaging, while back rest member 20 and strut member 22 can be simply carried inside the boat.

Back rest member 20 is preferably a rigid, lightweight member such as a hollow metal tube. A particularly suitable member is an aluminum tube having a rectangular cross-section measuring about 2.5 inches (6.25 cm.) by ⅜ inch (0.9 cm.). For most canoes or boats back rest member 20 need be no longer than about 2 feet (about 0.6 meter), although it may be longer or shorter than this if desired.

Strut member 22 is shorter than back rest member 20 and has a first end 32 and a second end 34. End 32 is adapted to be coupled to lower end 26 of the back rest member 20. End 34 is adapted to be supported against the front portion 36 of seat 16. In the embodiment shown in FIGS. 1 and 2 end 34 is supported against the underside of seat 16 and against the inside of downturned lip 37. If the seat is of a type not having a downturned lip, one may be provided thereon, for example, by fastening a short piece of right angle metal to the seat.

End 32 may be coupled to lower end 26 in various manners. Preferably the strut member is detachably coupled to the back rest member, although such members can be permanently coupled, for example, by means of a hinge or pin. In one embodiment back rest member 20 is a hollow tube whose lower end 26 is adapted to receive therewithin an upturned end of strut member 22. In another embodiment both back rest member 20 and strut member 22 are hollow tubes and a small V-shaped metal bar 35, having a width and thickness slightly less than the size of the openings in members 20 and 22, is slipped into end 26 and end 32 so as to hold said members 20 and 22 in fixed relation in assembled form. The apex or joint formed by ends 32 and 26 is supported by the floor 14 of boat 10. Preferably the apex is located under the back portion of seat 16 as opposed to being under the front portion of the seat so that the horizontal component of the force exerted against the seat by strut member 22 is maximized.

Strut member 22 is preferably a rigid, hollow metal tube. A particularly suitable member is an aluminum tube having a rectangular cross-section measuring about 2.5 inches (6.25 cm.) by ⅜ inch (0.9 cm.). The length of member 22 may vary, although generally a length of about 10–13 inches (about 25–33 cm.) is generally preferred (depending upon the distance between the seat and the floor of the boat).

Brace means 24 is adapted to cooperate with the back rest member 20 to transmit rearward force applied by an occupant of the seat 16 to the strut member 22 and the front portion 36 of the seat 16. Thus, when rearward force is applied to back rest member 20 by an occupant of seat 16, brace means 24 re-directs the bulk of the force by transmitting it to strut member 22 whereby some of the force is distributed to end 32 in contact with floor 14 while the remaining force is distributed to end 34 which is supported against the front portion 36 of the seat. The weight of the occupant in the seat then balances forces applied thereto by the assembly. Consequently, the back support assembly evenly distributes the rearward force applied to it in such a manner that no unsafe stress is created on any part of the rigidly disposed seat or of the boat.

In the embodiment shown in the drawings brace means 24 comprises an elongated loop whose length is adjustable. Brace means 24 is connected at one end to back rest member 20 (for example, by merely being looped around member 20) and is connected at the opposite end to the front of seat 16. A relatively simple, light-weight and inexpensive brace means comprises two U-shaped heavy gauge rod or wire loops connected together under seat 16 by means of adjustable clamps 40.

Figure 2:
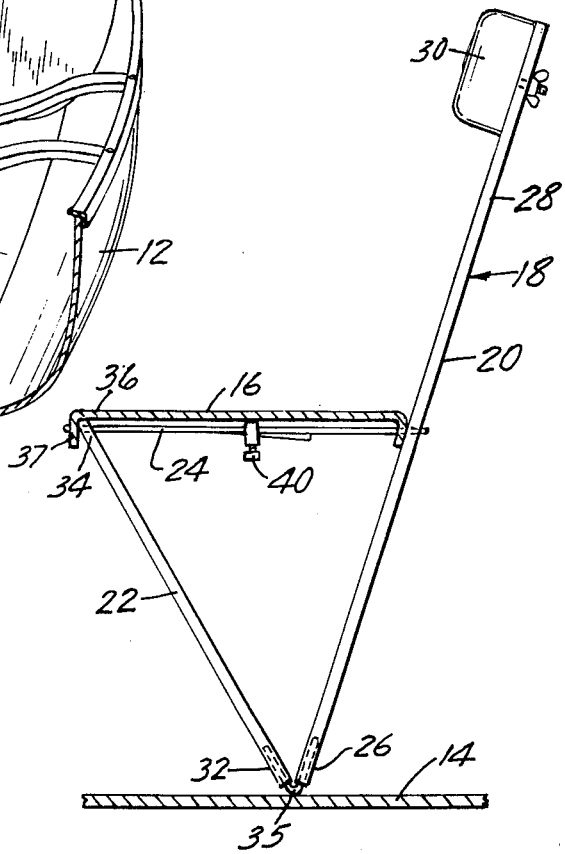
FIG. 2 is a cross-sectional view of the back support assembly of FIG. 1.

In a preferred embodiment brace means 24 is simply carried by the underside of seat 16 by passing through appropriately spaced apertures on the downturned lips of the seat. This is shown in FIGS. 1 and 2. With this embodiment brace means 24 remains with the seat at all times. This embodiment has the further advantage of permitting the back support assembly to be readily switched from one side of the seat 16 to the other since the brace means 24 will travel within the apertures so as to accommodate the back rest member 20 on either side of the seat. For greatest stability it is preferred that end 34 of strut member 22 be disposed between the arms of the loop as shown in FIGS. 1 and 2. If desired the brace means 24 may include a spring or other known device capable of being stretched a limited amount when force is applied thereto for the purpose of imparting limited movement of the back rest member with respect to the seat 16.

Figure 3:
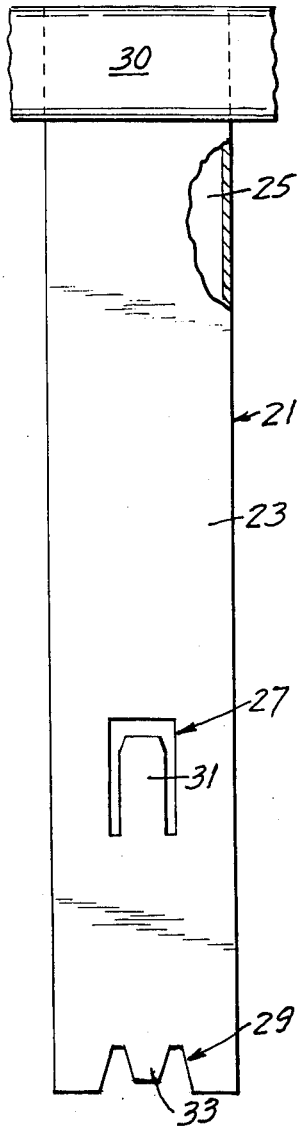
FIGS. 3 and 4 are elevational views of a second embodiment of a back support.

In FIG. 3 there is shown an elevational view of a second embodiment of a back support 21 which comprises an elongated bar 23 having an upper back rest portion 25 and a lower portion having first attachment means 27 and second attachment means 29 vertically separated from each other. Resilient pad means 30 is preferably removably attached to the upper end of bar 23, and preferably is adjustable up and down, to make the back support more comfortable in use. Bar 23 is typically a rigid aluminum bar having dimensions, for example, measuring 14 inches long by 2.5 inches wide by 0.25 inch thick (35 cm. × 6.2 cm. × 0.6 cm.), although the dimensions may be varied. Of course, other materials may also be used for this purpose (e.g., a hollow tube; high strength plastics; etc).

Attachment means 27 comprises an upwardly projecting finger 31 adapted to be received within, for example, a loop retaining means attached to a rigidly disposed surface in the boat, and attachment means 29 comprises a downwardly projecting finger 33 adapted to be received within another loop retaining means attached to a rigidly disposed surface in the boat. In preferred form fingers 31 and 33 are in the same plane as bar 23 and are integral therewith, as shown in FIG. 3, although such fingers could also be disposed at a spaced distance from, and secured to, bar 23 if desired.

The width of fingers 31 and 33 may vary, although a width of about one inch (2.5 cm.) is ordinarily sufficient. The length of finger 31 may be, for example, about 1.5 inches (3.7 cm.) although this is not critical. The length of the downwardly projecting finger 33 is normally shorter than finger 31 and may be, for example, about ¾ inch (2 cm.).

Figure 4:
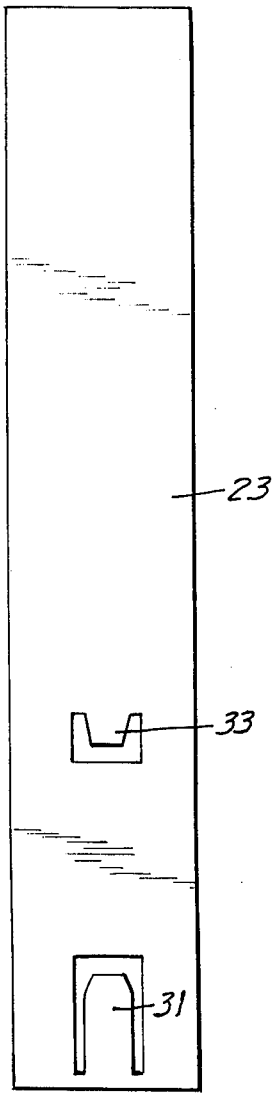

Although upwardly projecting finger 31 is shown as being above downwardly projecting finger 33, the relative positions of these fingers could be reversed, for example, as shown in FIG. 4. The advantage of having a downwardly projecting finger and an upwardly projecting finger is that these opposing fingers effectively prevent bar 23 from being inadvertently jostled out of securement (even if the boat is tipped over).

Figure 5:
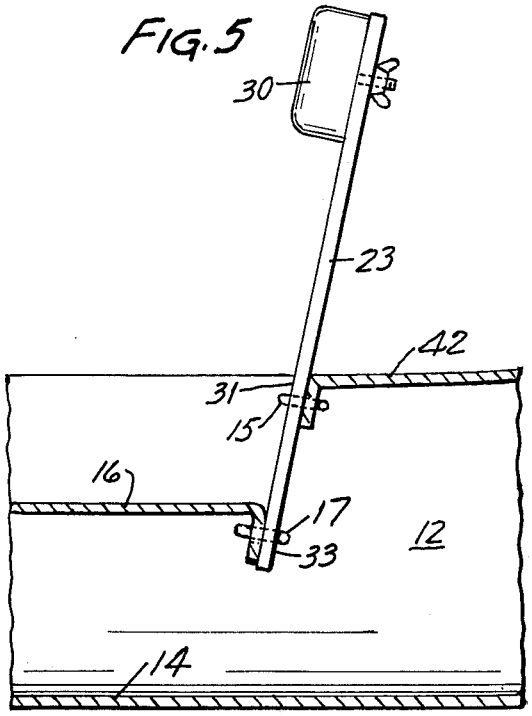
FIG. 5 is a perspective view showing one manner in which the back support of FIGS. 3 and 4 can be used in a conventional boat.

In FIG. 5 there is shown one manner in which the back support of FIGS. 3 and 4 may be used in a conventional boat such as a canoe. Thus, the elongated bar 23 is disposed in a generally upright manner with respect to seat 16. Finger 31 is received within loop retaining means 15 and finger 33 is received within loop retaining means 17.

Loop-shaped retaining means 15 is shown as being anchored on rigidly disposed deck member 42, and loop-shaped retaining means 17 is shown as being anchored on rigidly disposed seat 16. It is also possible to anchor the loop-shaped retaining means to thwarts or cross-members in the boat, depending upon the relative spacing between the seat and the thwart or cross-member. It is also possible, although less preferred, to mount both of the loop-shaped retaining means onto a single rigidly disposed upright surface if such surface is located in close proximity to the seat. The only requirement is that the loop-shaped retaining means be vertically separated from each other (at an appropriate spacing) and be anchored to a rigidly disposed member, or members, in the boat. So that the bar 23 is properly supported in the boat, the loop-shaped retaining means 15 and 17 are separated or spaced apart from one another at a distance which is less than the span of the two fingers in bar 23. Preferably, the spacing of the retaining means is about ¾ inch (2 cm.) less than the span of the fingers.

This type of back support is extremely easy to connect and it remains steady in position even when there is no rearward force applied to it. When an occupant of the seat exerts force against the back support the force is distributed between the rigidly disposed deck (or thwart or other cross-member) and the back of the seat (or other rigidly disposed member). No undesirable torque is created to damage the seat or other portion of the boat.

Other variants are possible within the scope of the present invention.

What is claimed is:

1. A back support assembly adapted for use in a conventional boat having a rigidly disposed seat, said back support assembly comprising:

a. an elongated back rest member adapted to be disposed in an upright manner with respect to said seat with the lower end of said back rest member being at a point near the floor of said boat and the other end of said back rest member being above said seat;

b. a strut member having a first end and a second end, wherein said first end of said strut member is adapted to be coupled to said lower end of said back rest member near the floor of said boat, and said second end is adapted to be supported against the underside of the front portion of said seat; and c. brace means under said seat adapted to cooperate with said back rest member to transmit rearward force applied to said back rest member by an occupant of said seat to said strut member, said front portion of said seat, and said floor of said boat.

2. A back support assembly in accordance with claim 1, wherein said brace means is slideably mounted on the underside of said seat and one of its ends engages said back rest member and the other of its ends engages said front portion of said seat.

3. A back support assembly in accordance with claim 2, wherein said brace means is in the shape of an elongated loop.

4. A back support assembly in accordance with claim 3, wherein the length of said loop is adjustable.

5. A back support assembly in accordance with claim 4, wherein said loop comprises two U-shaped wires connected to each other by adjustable clamps.

6. A back support assembly in accordance with claim 1, wherein resilient pad means is carried by said back rest member.

7. A back support assembly in accordance with claim 1, wherein said first end of said strut member is detachably coupled to one end of said back rest member.

8. A back support assembly in accordance with claim 1, wherein said back rest member and said strut member each comprise a hollow metal tube, and wherein said back rest member and said strut member are detachably coupled together by means of a V-shaped metal bar.

9. A back support adapted to be removably attached to a conventional boat carrying at least two loop shaped retaining means vertically separated from each other therein, said back support comprising an elongated bar having an upper back rest portion and a lower portion, said lower portion having first and second attachment means vertically separated from each other on said bar, said first attachment means comprising an upwardly projecting finger adapted to be received by one of said loop shaped retaining means in said boat, and said second attachment means comprising a downwardly projecting finger adapted to be received by the other of said loop shaped retaining means.

10. A back support in accordance with claim 9, wherein resilient pad means is carried by said upper back rest portion.

11. A back support in accordance with claim 9, wherein said first attachment means is above said second attachment means.

12. A back support in accordance with claim 9, wherein said first attachment means is in the plane of said bar and integral therewith.

* * * * *